US007798471B2

(12) United States Patent
Christopher

(10) Patent No.: US 7,798,471 B2
(45) Date of Patent: Sep. 21, 2010

(54) DIRECT ACTING SINGLE SHEAVE ACTIVE/PASSIVE HEAVE COMPENSATOR

(75) Inventor: Terry Christopher, Woodbury, MN (US)

(73) Assignee: Hydralift AmClyde, Inc., St. Paul, MN (US)

( * ) Notice: Subject to any disclaimer, the term of this patent is extended or adjusted under 35 U.S.C. 154(b) by 287 days.

(21) Appl. No.: 11/838,622

(22) Filed: Aug. 14, 2007

(65) Prior Publication Data

US 2008/0105433 A1 May 8, 2008

Related U.S. Application Data

(60) Provisional application No. 60/822,490, filed on Aug. 15, 2006.

(51) Int. Cl.
*B66D 1/00* (2006.01)

(52) U.S. Cl. ..... 254/277; 254/278; 254/335; 166/355; 212/308; 212/309; 114/253; 114/243

(58) Field of Classification Search ..... 254/275, 254/277, 278, 335; 212/308, 309; 166/355, 166/352; 114/244, 253, 254, 243
See application file for complete search history.

(56) References Cited

U.S. PATENT DOCUMENTS 3,943,868 A 3/1976 Person et al.
4,039,177 A 8/1977 Person et al.
4,085,509 A 4/1978 Bell et al.
4,091,356 A 5/1978 Hutchins
4,104,608 A 8/1978 Melling et al.
4,135,841 A 1/1979 Watkins
4,155,538 A 5/1979 Claassen
4,180,171 A * 12/1979 Cunningham et al. ..... 212/273
4,210,897 A 7/1980 Hutchins
4,272,059 A 6/1981 Noerager et al.
4,367,981 A 1/1983 Shapiro
4,382,361 A 5/1983 Blanchet
4,428,421 A 1/1984 Rankin
4,432,420 A 2/1984 Gregory et al.
4,448,396 A 5/1984 Delago
4,506,591 A 3/1985 Blanchet
4,612,984 A 9/1986 Crawford
4,620,692 A 11/1986 Foreman et al.
4,633,951 A 1/1987 Hill et al.
4,682,657 A 7/1987 Crawford
4,697,253 A 9/1987 Lind et al.
4,699,216 A 10/1987 Rankin
4,718,493 A 1/1988 Hill et al.
4,830,107 A 5/1989 Rumbaugh (Continued)

FOREIGN PATENT DOCUMENTS

GB 2168944 A1 7/1986

*Primary Examiner*—Emmanuel M Marcelo
(74) *Attorney, Agent, or Firm*—Dorsey & Whitney LLP; Stuart R. Hemphill, Esq.

(57) ABSTRACT

A heave compensation system provides a direct acting heave compensator that reduces stress and fatigue on a line, the system includes a single sheave system that compensates for heave as it carries a load line and moves along a curve profile of the heave compensator tangent to the point the load line comes off of a line handling system. The length of the line extending from the line handling system to the sheave remains substantially the same length during heave compensation operations, and the point where the line takes off from the line handling system is substantially the only point of changing stress on the line.

29 Claims, 7 Drawing Sheets

U.S. PATENT DOCUMENTS 4,858,694 A 8/1989 Johnson et al.
4,905,763 A 3/1990 Sauer et al.
4,913,238 A 4/1990 Danazcko et al.
4,913,592 A 4/1990 Petty et al.
4,923,012 A 5/1990 Hopmann
4,928,770 A 5/1990 Murray
4,928,771 A 5/1990 Vandevier
4,934,870 A 6/1990 Petty et al.
4,962,817 A * 10/1990 Jones et al. ..... 175/5
5,190,107 A 3/1993 Langner et al.
5,209,302 A 5/1993 Robichaux et al.
H1232 H 9/1993 DiSiena
5,377,763 A 1/1995 Pearce et al.
5,509,513 A 4/1996 Kiesel
5,510,988 A 4/1996 Majeed et al.
5,551,803 A 9/1996 Pallini, Jr. et al.
5,558,467 A 9/1996 Horton
5,660,235 A 8/1997 Sola
5,894,895 A * 4/1999 Welsh ..... 175/5
5,980,159 A 11/1999 Kazim
6,000,480 A 12/1999 Eik
6,082,947 A 7/2000 Adamson
6,189,621 B1 2/2001 Vail, III
6,196,325 B1 3/2001 Connell et al.
6,216,789 B1 4/2001 Lorsignol et al.
6,241,425 B1 6/2001 Kazim
6,354,380 B1 3/2002 Becnel et al.
6,367,553 B1 4/2002 Boyd
6,412,554 B1 7/2002 Allen et al.
6,467,593 B1 10/2002 Corradini et al.
6,478,086 B1 11/2002 Hansen
6,517,291 B1 2/2003 Pollack
6,530,430 B2 3/2003 Reynolds
6,691,784 B1 2/2004 Wanvik
6,712,560 B1 3/2004 Cottrell
6,739,395 B2 5/2004 Reynolds
6,789,981 B2 9/2004 Pollack
6,817,422 B2 11/2004 Jordan
6,836,707 B2 12/2004 Sowada et al.
6,840,326 B2 1/2005 Shiyou
6,913,084 B2 7/2005 Boyd
6,915,849 B2 7/2005 Nuth
6,926,259 B1 * 8/2005 Roodenburg et al. ..... 254/277
6,932,326 B1 * 8/2005 Krabbendam ..... 254/334
6,968,900 B2 11/2005 Williams et al.
7,008,340 B2 3/2006 Williams et al.
7,051,814 B2 5/2006 Goode et al.
7,063,159 B2 6/2006 Patton et al.
7,073,602 B2 7/2006 Simpson et al.
2002/0197115 A1 12/2002 Borseth
2003/0107029 A1 6/2003 Hanson et al.
2004/0026081 A1 2/2004 Horton, III
2005/0077049 A1 4/2005 Moe et al.
2005/0087731 A1 4/2005 Scott
2005/0179021 A1 8/2005 Selcer et al.
2005/0211430 A1 9/2005 Patton et al.
2005/0242332 A1 11/2005 Ueki et al.
2006/0016605 A1 1/2006 Coles
2006/0078390 A1 4/2006 Olsen et al.

* cited by examiner

DIRECT ACTING SINGLE SHEAVE ACTIVE/PASSIVE HEAVE COMPENSATOR

CROSS-REFERENCE TO RELATED APPLICATIONS

This application claims benefit of priority to the provisional application U.S. Ser. No. 60/822,490, filed Aug. 15, 2006.

BACKGROUND

Heave compensation for vessels and/or their loads can be critical for offshore lifting and landing operations. This is because it may be desirable for a vessel subject to wave action to maintain the load in a fixed location and/or at a constant tension. Heave compensation systems may operate in a variety of ways including via active heave compensation modes where the system controls the position of the load, passive heave compensation modes where the system controls the tension on the load, and combinations of both active and passive heave compensation modes.

A winch-based heave compensation system may operate in both a passive and active mode, may be part of a main winch that controls the line supporting a load, and may include a number of sheaves that the line passes over as the winch undergoes a spooling movement. One disadvantage of some heave compensation systems is that the line moves over or flexes at one or more (often multiple) elements in the compensation system and may be damaged or fail due to fatigue caused by the line continuously bending back-and-forth over the elements (by travel or flexing without line travel) when the heave compensation system is operating. This problem is particularly present with lighter-weight lines made from fiber materials other than steel. Therefore, there is a need for a heave compensation system that operates to reduce the amount of fatigue on the line in order to prevent line damage or failure.

SUMMARY

In one embodiment, a heave compensation system is provided that reduces stress and fatigue on a line by providing a direct acting heave compensator with a single sheave system that moves up and down on a curve profile defined by the heave compensator.

Another embodiment provides a heave compensation apparatus for a load suspended from one end of a line into a marine environment, where the other end of the line is handled by a vessel. The load compensation apparatus comprises: a sheave support base, a sheave that receives the line from a line handling device, a sheave mounting frame with an axle, and a compensator control that controls sheave position and motion. The line handling device may be located at a first location on the vessel and is at least partially responsible for handling the line. The sheave support base may be located at a second location on the vessel that is displaced from the first location. The sheave may be configured for receiving the line from the line handling device and for directing it to the load. The sheave mounting frame with the axle supports the sheave, where the sheave mounting frame is mounted on the sheave support base for reciprocating motion along a compensation path extending in the general direction of a heaving motion to be compensated. The compensator control may be operatively connected to the sheave mounting frame for causing the sheave mounting frame to controllably reciprocate along a compensation path in response to heaving motion of the vessel.

In another embodiment, an apparatus provides heave compensation for a load suspended from one end of a line into a marine environment, and the other end of the line is handled by a vessel. The apparatus includes a sheave that receives the line from a line handling device, and is controlled to move on a compensation path. The line handling device may be located at a first location on the vessel for handling the line. The sheave is configured to receive the line from the line handling device and to direct it to the load. The sheave may be movably coupled to a base located at a second location on the vessel displaced from the first location. A compensator control operably connected to the movable sheave provides reciprocating motion along a compensation path extending in the general direction of a heaving motion to be compensated. The compensation path follows a curve profile defined by the base that keeps an axle of the sheave at a substantially constant distance from the point at which the line leaves the line handling device to extend to the sheave.

DETAILED DESCRIPTION

Figure 1:
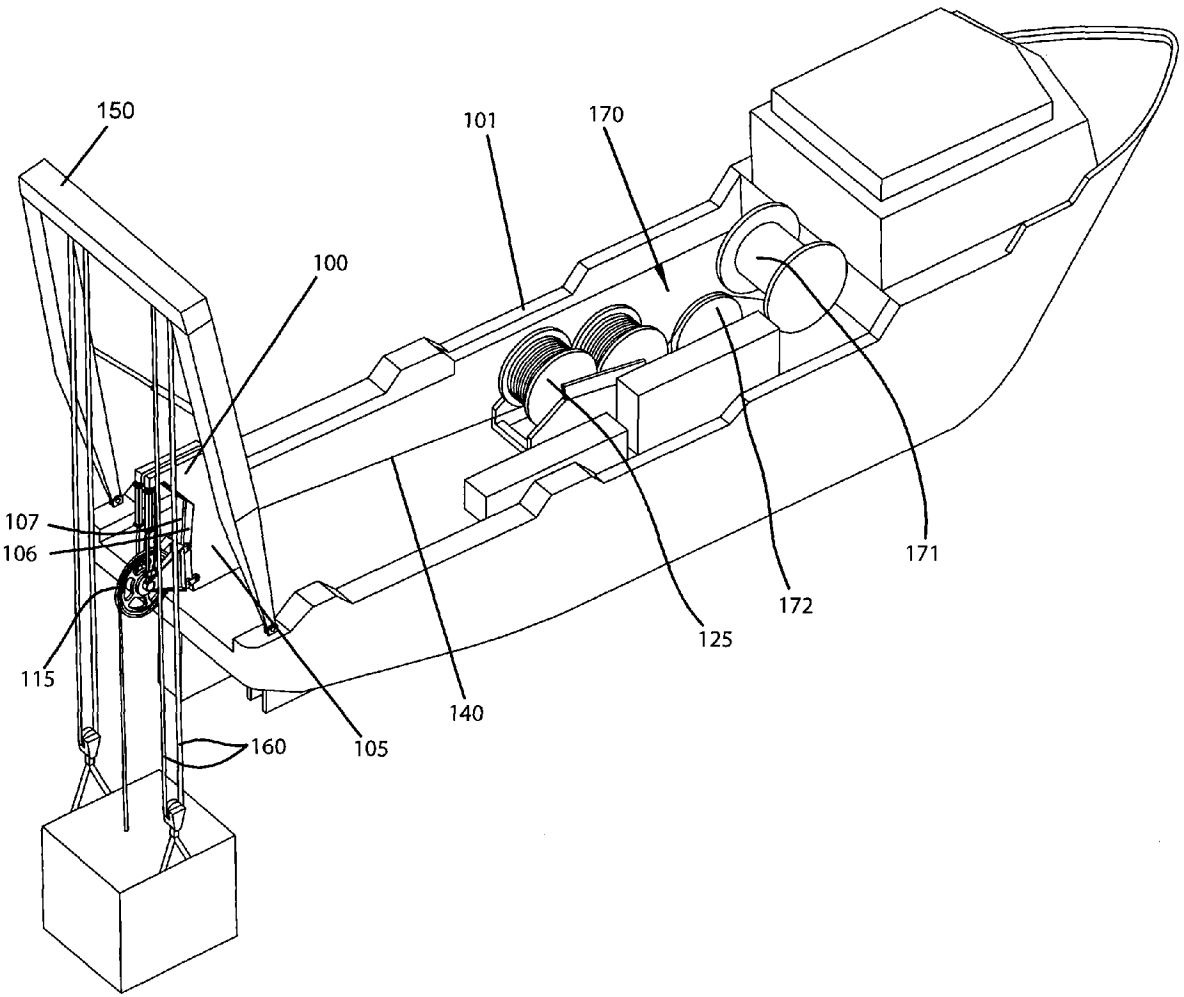
FIG. 1 depicts a vessel that employs a heave compensation system.

Overview. Certain embodiments of the present invention provide a direct acting heave compensation system that employs a traction winch, a support base, and a movably mounted compensator sheave that receives a line extending from the traction winch to the compensator sheave. The line originates, for example, from a tension drum of the traction winch and extends a distance to the compensator sheave where it wraps around a portion of the sheave and then extends generally downward to terminate at the load. The line has a central drum tangent point where it takes off from the tension drum when the heave compensation system is at its central or normal position. In addition, when the heave compensation sheave is at maximum upward or a maximum downward compensation position, the line forms other tangent points at the tension drum, due to changes from the central position line angle. As the line moves from the drum tangent point of the maximum upward position to the drum tangent point of the minimum downward position, an arc-like path is described. The base for the movably mounted sheave is configured to provide a curved rail or guide surface having a curve profile determined generally by the arc-like motion from the various tangent points where the line departs off the traction winch as it extends to the support base. According to this embodiment, as the line pivots through the arc-like path, the line is carried along the curve profile of the rail by the movably mounted sheave. Because the sheave is movable along the rail and the curve profile reflects the sheave, line and tension drum location and geometry, at each heave compensation position of the sheave, it stays substantially the same distance from the corresponding tangent point of the line at the traction winch; thus, the line segment between the compensator sheave and the tension drum stays substantially the same length and the changes in stress in the line are reduced. The sheave rotates little or not at all in response to heave, and without sheave rotation, the line does not move over the sheave. In addition, the line only changes by a limited amount its angle at the tension drum at the point of first contact with the compensator sheave.

Heave compensation systems of the present design are suitable for offshore floating vessels including ships and mobile platforms. For example, the present heave compensation systems may be employed on offshore floating platforms for oil wells or on ships used for performing oil drilling, production and/or storage or servicing offshore installations. Applications of heave compensation systems may include deepwater lowering applications such as deepwater lowering of subsea structures, suction anchors, or any load requiring positioning on the seabed. Those skilled in the art will understand that any suitable vessel may employ the disclosed heave compensation systems, methods, and applications, which are not limited by the examples described.

Some embodiments provide heave compensation for loads suspended by a line. A load may be, for example, a 250-ton load of production or transmission equipment, an oil line, or any type of load suspended into a marine environment from offshore vessels. A line may be, for example, a wire rope or a fiber-type rope made from fibers such as polyethylene or Kevlar. In one example, the rope is a 160 mm fiber rope.

Turning to the figures, FIG. 1 depicts a vessel 101 that employs a heave compensation system according to some embodiments. Vessel 101 is equipped with a line handling system 170 at one location on the vessel 101, spaced apart from the heave compensation apparatus 100. Line handling system 170 serves to handle line 140 by storing the line on a drum or take-up winch 171 where the line 140 runs to traction winch 125 via tensioning sheave 172 which helps maintain constant tension on a low tension side of the traction winch 125, i.e., the side of the traction winch 125 proximal to take-up winch 171. The line handling system 170 may hold, in-haul or pay out line 140, and each of take-up winch 171, tensioning sheave 172, and traction winch 125 may have a horizontal axis of rotation.

Although a traction winch is shown in FIG. 1, a single drum winch, a linear winch, or other line handling or holding devices may be used. For example, line 140 may run from a drum or sheave or gripper jaws of the line handling system 170 to the heave compensation apparatus 100.

In FIG. 1, line 140 runs from the traction winch 125 to the heave compensation apparatus 100 and is directed by sheave 115 of the heave compensation apparatus 100 down to load 145. Heave compensation apparatus 100 provides proper compensation for line 140 when the vessel experiences shifting or heaving to reduce or eliminate line travel over the sheave 115; the sheave 115 moves up and down along a curve profile for a compensation path defined by guide surfaces 106, 107 of the heave compensation apparatus 100. The curve profile is adapted to cause the length of line 140 extending from the traction winch 125 to the sheave 115 of heave compensation apparatus 100 to remain substantially constant. Because the line 140 shifts during compensation and wraps/unwraps slightly around traction winch 125 and sheave 115, line 140 undergoes minimal flexing and substantially no travel from the heave compensation process. The line 140 may have a flexing point at any one of various departure points from the traction winch 125, and the heave compensation apparatus 100 provides movement up and down on a curve profile of the apparatus 100 to allow the length of the line 140 between the sheave 115 and the traction winch 125 to remain substantially constant.

Over-boarding structure or A-frame 150 with support lines 160 is provided to enable load 145 to be lifted from vessel 101, above and over heave compensation apparatus 100, and lowered toward the marine environment surface where A-frame 150 releases the load 145 from its lines 160 and transfers the load 145 to heave compensation apparatus 100 and line 140.

Figure 2:
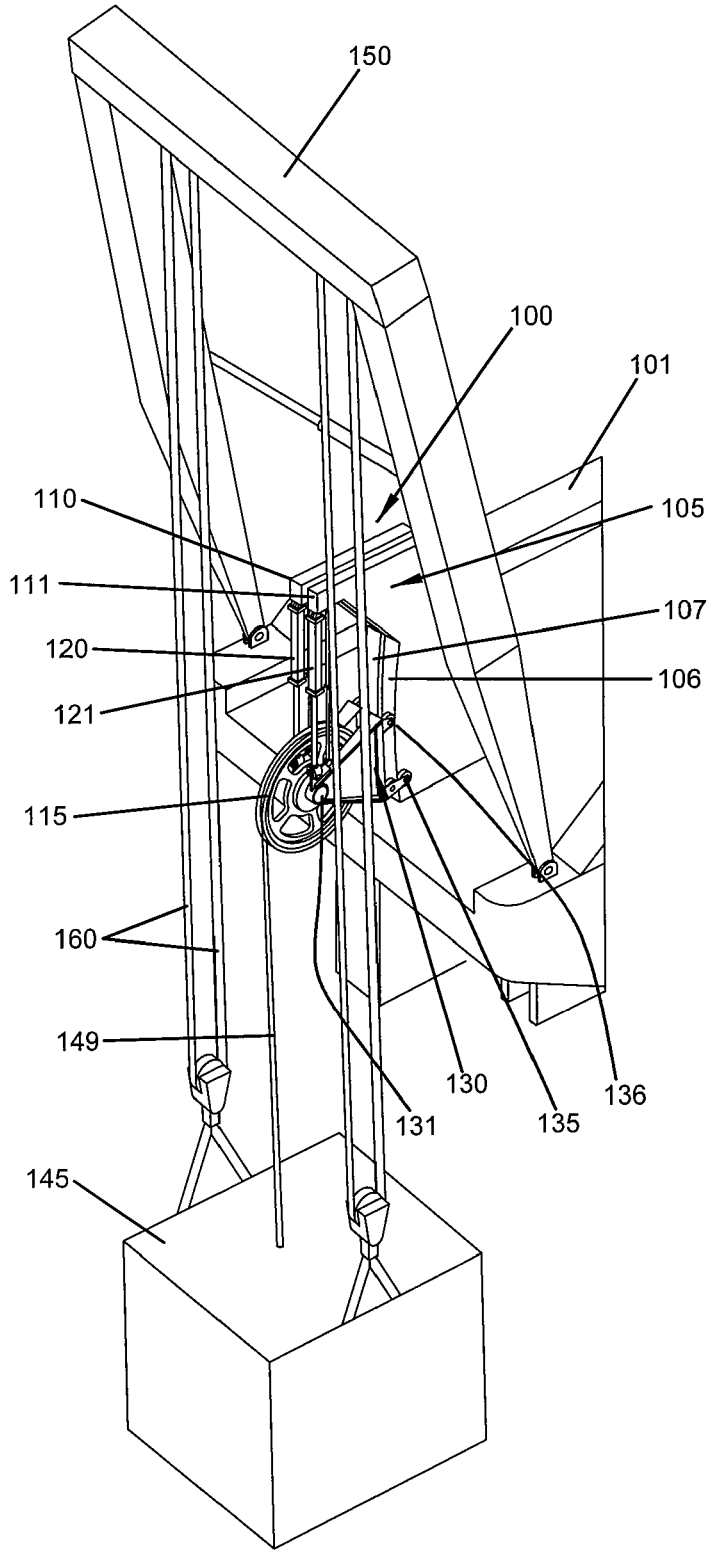
FIG. 2 depicts a heave compensation apparatus on a vessel with a suspended load.

Heave Compensator. FIG. 2 depicts a heave compensation apparatus 100 with a sheave support base 105 securely mounted at a location of vessel 101 near where line 140 and load 145 enter the marine environment. FIG. 2 shows support base 105 extending over the vessel stem. Base 105 may be bisected to form symmetrical base halves 110, 111 to enable the line 140 to pass between the halves of the base 105 to compensator sheave 115 without contacting the base halves 110, 111. Sheave 115 is mounted for rotation on sheave mounting frame 130 with axle 131.

Base halves 110, 111 include a curve profile defined at guide surfaces 106, 107, the shape of which correspond to a compensation path that keeps the axle 131 of the sheave support frame 130 at a substantially constant distance from the point at which the line 140 leaves the line handling device (not shown in FIG. 2) to extend to the sheave 115. Guide surfaces 106, 107 have a curve profile dependent on the displacement distance between sheave 115 and line handling device 120, the diameter of line 140 and the wrapping/unwrapping surfaces at each end of the line segment extending over the displacement distance between the sheave 115 and where the line takes off from the line handling system (see FIG. 4). Viewed simplistically as arc-like, the curve profile would typically encompass an arc-like range of about +/−4 degrees, preferably about +/−2 degrees.

Guide surfaces 106, 107 serve as a guide for guiding movement of sheave mounting frame 130. The frame 130 may be movably supported by base 105 using one or more support devices, 120, 121. In some embodiments, sheave mounting frame 130 includes upper and lower pairs of rollers 135, 136 to cause the sheave mounting frame 130 to roll along the respective guide surfaces 106, 107 of the base halves 110, 111. In one example, rollers 135, 136 may be shaped in a manner that is complementary to guide surfaces 106, 107. Thus, guide surfaces 106, 107 may take the form of convex rails arranged to accept wheels having a concave contact surface. In another example, as seen in FIG. 3, two sets of two, opposed rollers (e.g., 132, 134 in FIG. 3*a*) may be positioned at the bottom end of the sheave mounting frame 130, and one set of two rollers may be positioned at the top end of the sheave mounting frame 130 (e.g., 136 in FIG. 3*a*). One of the sets of two, opposed rollers at the bottom end may be may be positioned on opposite sides of a flange (not shown in the Figs.) extending from the base 105.

Although rollers 135, 136 are shown in FIG. 2, it should be understood that other structures to permit motion along the guide surfaces 106, 107 may be coupled to the sheave mounting frame 130. These may include other forms of rails and rollers. Further, skidding or bearing material using pins in grooves, flat bearing pads on flat tracks or other similar friction reducing structures may be used to aid in movement of sheave mounting frame 130 along guide surfaces 106, 107.

Sheave mounting frame 130 mounts sheave 115 for rotation at sheave axle 131, and sheave 115 may be sized so as to accommodate any desirable line size, such as 80-160 mm fiber ropes. In addition, sheave 115 may be sized so that the D:d ratio (see discussion of FIG. 7 below) is about 30:1.

However, any D to d ratio may be selected depending on the amount of stress acceptable for line 140. Because sheave mounting frame 130 moves along the guide surfaces 106, 107, sheave 115 is carried by sheave mounting frame 130 along essentially the same path.

According to FIG. 2, base halves 110, 111 also provide a mounting point for compensation control elements; in one embodiment the base halves 110, 111 suspend a first end of a pair of cylinders 120, 121, respectively. Cylinders 120, 121 may be active or passive cylinders, and may be coupled at a second end to sheave support frame 130. Cylinders 120, 121 serve to enable the sheave mounting frame 130 to be moved in response to heaving motions of the vessel 101 by reciprocating along a compensation path defined by guide surfaces 106, 107, via rollers 135, 136. In certain configurations one or more cylinders may be provided at each side of the sheave support frame 130. For example, one passive and one active cylinder may be provided at each side of the sheave support frame 130, providing a pair of passive cylinders (one on each side of the frame 130, i.e., side 130*a* and side 130*b* from FIG. 3*b*) and an adjacent pair of active cylinders. The use of active and passive cylinders, usually in combination, with a motion sensing system, is known from U.S. Pat. No. 6,082,947, issued Jul. 4, 2000 to Adamson, entitled "Coordinated motion marine lifting device". A cylinder-based compensation system is also available from the Hydralift division of National Oilwell Varco (formerly National Oilwell), which makes active heave compensation systems for cranes.

It should be understood by those skilled in the art that other compensator control structures may alternatively or additionally be provided. For example, other extensible structures such as levers and/or winch systems may be provided to support and move the sheave mounting frame 130 for load balancing and controlling tension on the load.

According to some embodiments, the compensation path is a curved profile path defined generally by the rotation of a point fixed on the line 140 adjacent the sheave 115 around a fixed point on the line handing system 170. However, this is an approximation and, as noted below, the wrapping/unwrapping action at the sheave 115 and the line handling system 170 is also accommodated in the compensation path. A curved profile is defined by the guide surfaces 106, 107 on base 105, and the sheave mounting frame 130 rides on the guide surface. The shape of the guide surfaces 106, 107 enables the length of the line from the line handling system 170 to the sheave 115 to remain substantially the same.

The heave compensation system 100, according to some embodiments, can operate both when the line handling system 170 handling the line is stationary and when it is operational. Because the compensation system 100 operates when load 145 is in-hauled or paid out, heave is compensated for, and the stress on line 140 is attributable primarily to the line movement caused by the line handling system 170. That is, when the line is in-hauled or paid out from a winch, the heave compensation system 100 reduces or avoids additional travel and flexing by the line beyond what results from the operations of the winch.

In some embodiments, the vessel 101 includes a motion reference unit 162 (depicted in FIGS. 3*a*, 3*d*) with sensors that sense vessel motion and a programmable data processor that relays the information to the compensator control structures, enabling the active compensator structures to respond accordingly. For example, the motion readout may be relayed to a Kalman filter on a computer where the computer processor determines a point of motion and calculates the motion relative to a stationary surface, such as the ocean floor or sea bed. The compensator control structures may react to the calculated motion data by exerting a pushing or pulling motion on the sheave mounting frame 130, causing the sheave mounting frame 130 to move along the curve profile of the base thereby compensating for vessel heaving motions.

Compensator control structures may be directed to exert an amount of pressure on the heave compensation apparatus required to hold the sheave 115 in place, or shift the sheave 115 up to reduce tension on the line or down to increase tension on the line. In some embodiments, the compensator in a fully extended position versus a fully retracted position may cause a change in line tension by + or −6% when operating in the passive heave compensation mode.

Figure 3D:
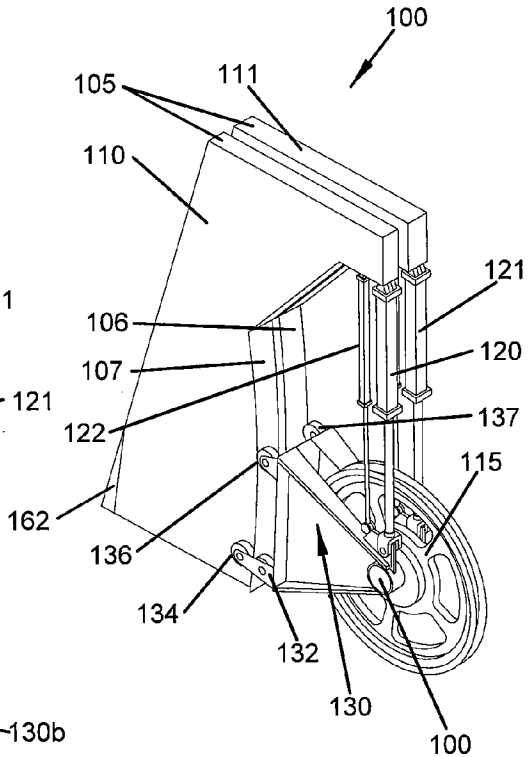
FIGS. 3*a-d* depict side, top, front and pictorial (respectively) views of a heave compensation apparatus.
Figure 3C:
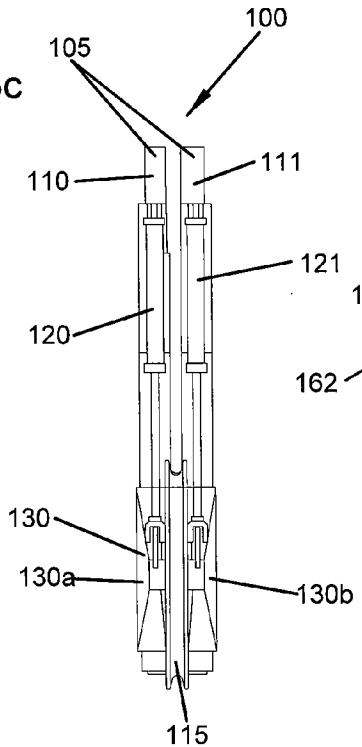
Figure 3B:
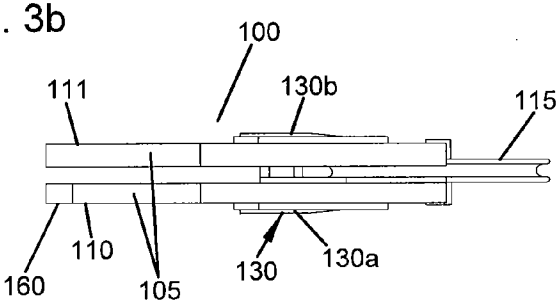

Compensator Base and Compensation Path. FIGS. 3*a*-*d* and 4 depict various additional views of the heave compensation apparatus 100. As can be seen in FIGS. 3*b* and 3*c*, base halves 110, 111 are symmetrical and are separated by a distance that is somewhat wider than the diameter of the line 140 (not shown in FIGS. 3*a*-3*d* and 4). As seen in FIG. 3*d*, each base half 110, 111 includes guide surfaces 106, 107 with an arc-like curve profile corresponding generally to an arc made by a point on line 140 near base 105 and/or by sheave axle 131 as the line 140 rotates and slightly wraps and unwraps about the line handling system 170 in response to heave motions. This compensation path is configured to allow the segment of the line 140 running between the line handling device 170 to the sheave 115 (FIG. 4) to remain substantially the same length.

Figure 3A:
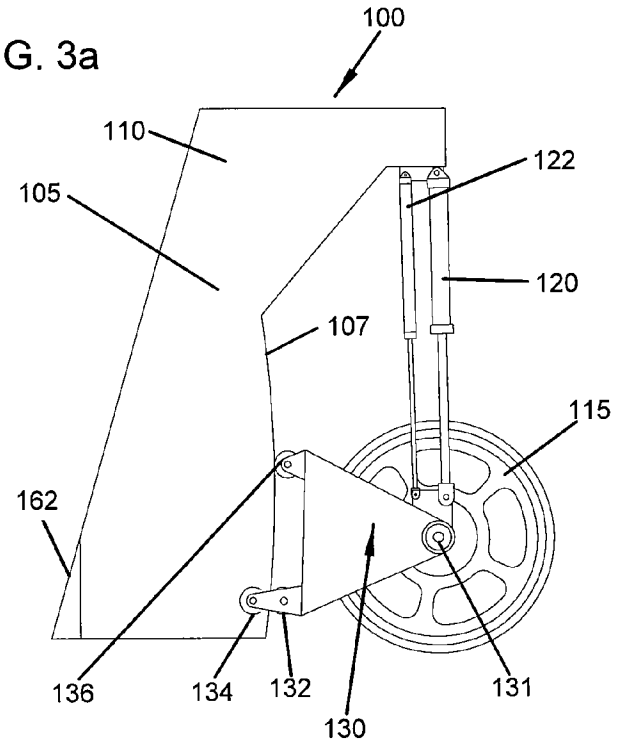
Figure 4:
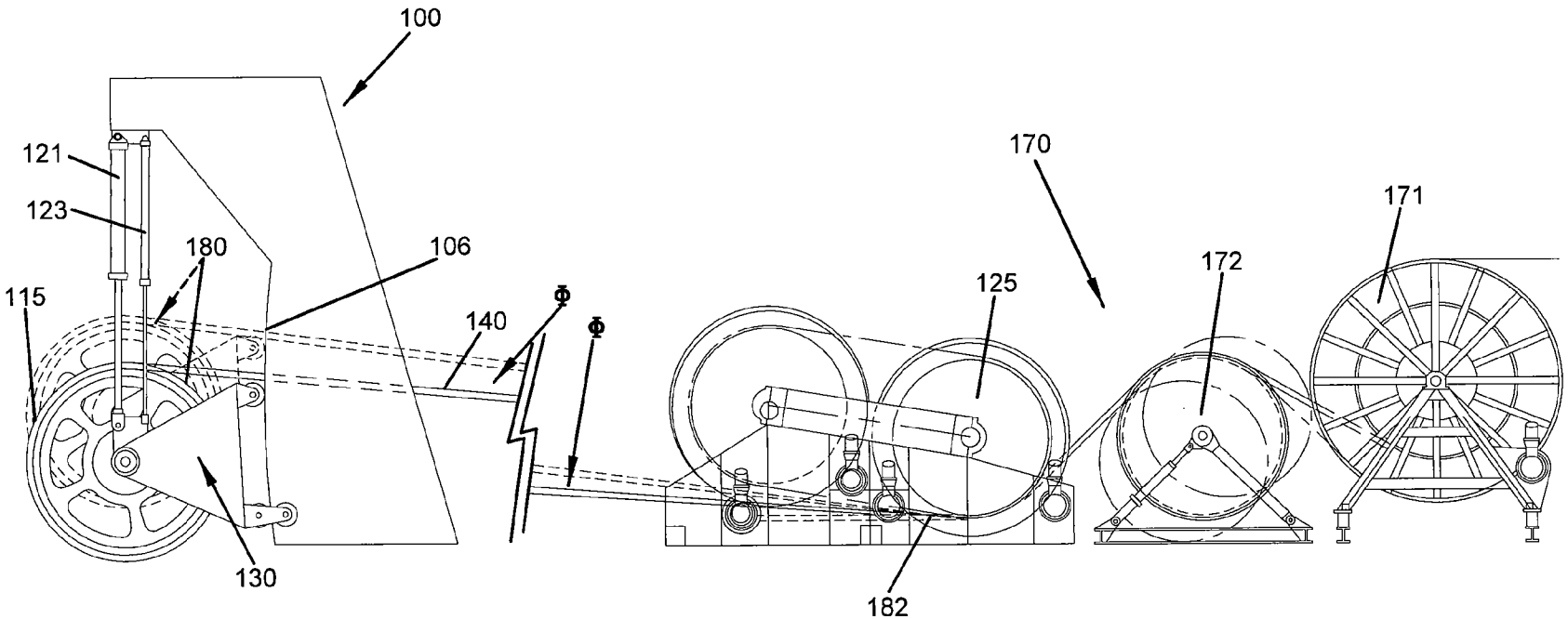
FIG. 4 depicts a heave compensation system with a line handling device.

In order to maintain a substantially constant length of line 140 between the line handling device 170 and the sheave 115, portions of heave compensation apparatus 100 are required to respond to vessel heave motions and to move the sheave 115 on its compensation path. In FIGS. 3*a*, 3*d* and 4, passive cylinders 120, 121 and active cylinders 122, 123 provide a support mechanism for the sheave mounting frame 130 and are also responsible for moving sheave mounting frame 130 along guide surfaces 106, 107 in response to vessel 101 heave motions, thereby providing active and passive heave compensation for the heave compensation apparatus 100. As can be seen in FIG. 3*d*, rollers 132-137 provided on both sides of the sheave mounting frame 130 face guide surfaces 106, 107 and allow the sheave mounting frame 130 to move along the compensation path. This enables sheave 115 carried by sheave mounting frame 130 to move along the compensation path without causing line 140 to travel, thereby compensating for heave without sheave 115 rotating. The segment of the line 140 passing from the sheave 115 to the tension winch 125 remains substantially the same length, and thus the line 140 is not in-hauled or paid out by reason of the heave compensation process.

In FIG. 4, line 140 comes off of the bottom portion of the distal drum of the traction winch 125 relative to the heave compensation apparatus 100 and extends through a bisected heave compensation apparatus base 105 directly to sheave 115. From FIG. 4, the angle Φ at which line 140 comes off of the drum of traction winch 125 changes as the vessel 101 undergoes heaving motion, and the positioning of the sheave 115 changes along with the change in line 140 angle Φ. The system is configured so that there is a central position on the compensation path that represents the mid-point of the wave action that causes heaving. Guide surfaces 106, 107 (107 not shown in FIG. 4) may be formed with a curve profile having a corresponding mid-point for the path taken by the sheave mounting frame axle 131 when line 140 moves between a maximum upward angle Φ and downward angle Φ in excursions from the midstroke position of cylinders used to provide compensation. FIG. 4 shows the sheave 115 at the low travel extreme in solid lines, with a second position shown in dotted lines as the sheave proceeds to the midpoint or central position on its way to the opposite extreme of compensation. As can further be seen in FIG. 4, a wrapping/unwrapping zone 180 will exist on sheave 115 with a corresponding wrapping/unwrapping zone 182 on the line handling device 170.

Figure 6:
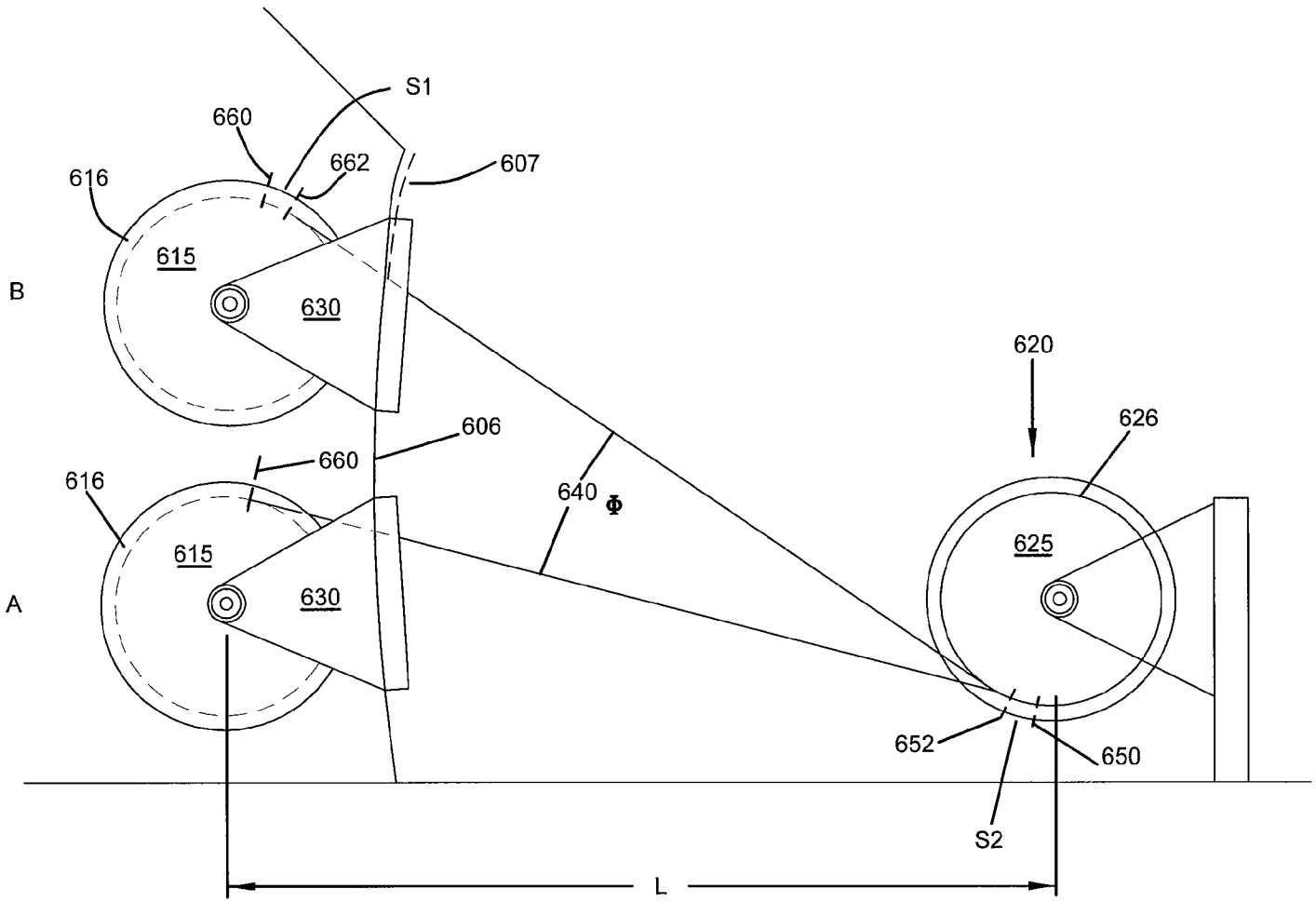
FIG. 6 is a schematic diagram showing geometrical factors for defining a compensation path curve profile.
Figure 7:
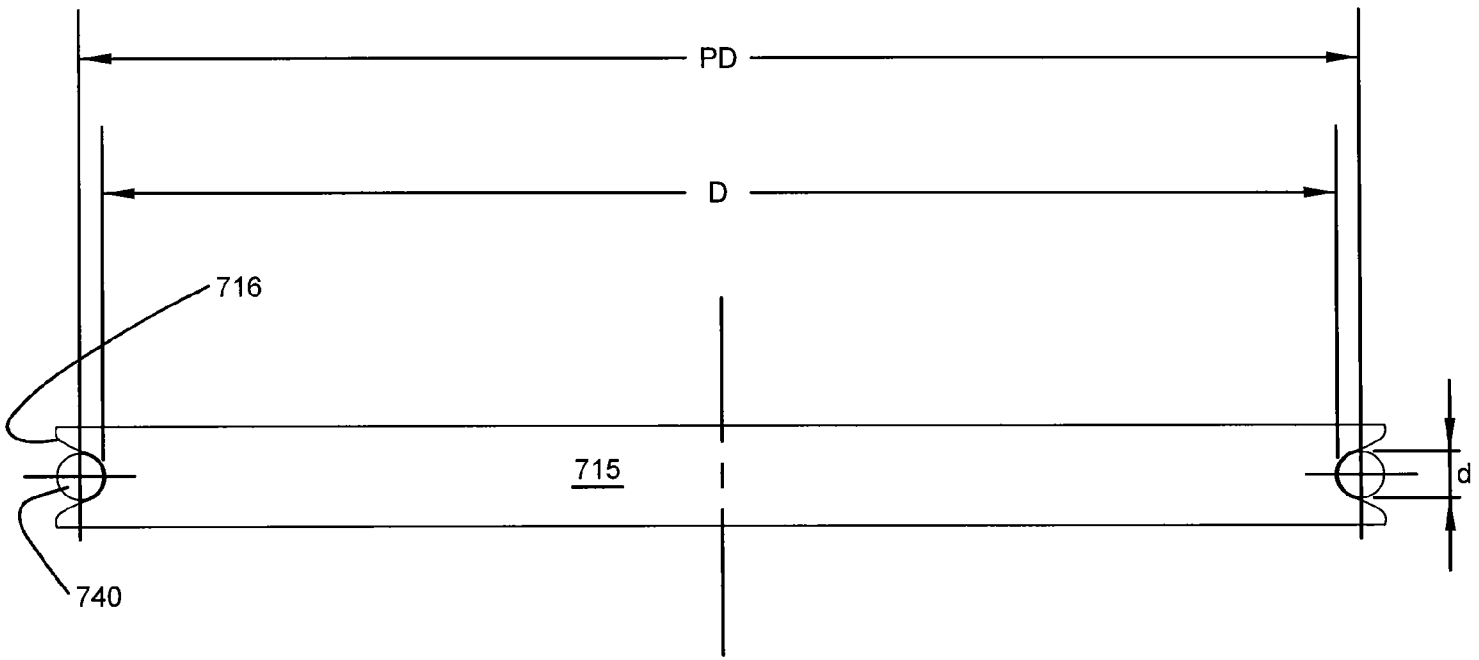
Prior Art FIG. 7
FIG. 7 is a schematic diagram of a sheave (prior art) showing certain dimensional features for defining a compensation path curve profile.

FIG. 6 shows schematically the geometry of the present device relevant to a compensation path. FIG. 7 shows a cross-sectional diagram of the key dimensions of a sheave and line relevant to the sheaves shown schematically in FIG. 6. As can be seen in FIG. 7, a sheave 715 has a pitch diameter PD and a root diameter D defined by a line-receiving groove 716. The line 740 that is received in the sheave groove has a diameter d. These dimensions define the D:d ratio. As further seen schematically in FIG. 6, a line handling device 620 has at least one drum 625 with a line 640 that extends from a line receiving groove 626 that defines its root diameter D. Also shown in FIG. 6 is a compensator sheave 615 in a lower position A and an upper position B. Position A represents one compensation path extreme that is located at the lower end (as seen in FIG. 6) of a compensation path curve profile 606. Position B represents a compensation path position that is above extreme position A (as seen in FIG. 6). Sheave 615 is mounted for rotation on sheave mounting frame 630 which moves along the compensation path curve profile 606 to be in position A or B or others defined by compensation path curve profile 606. Sheave 615 has a line receiving groove 616 that defines its root diameter D. For simplicity of exposition in this example, the root diameter D of drum 625 and of sheave 615 are assumed to be the same.

The exact configuration of the curve profile 606 depends on the amount of line wear that may be tolerated in a given application. While zero line travel resulting from heave compensation is the most desirable, heave compensation that sharply reduces the line travel is also beneficial. Thus, the curve profile is selected to reduce or eliminate line travel and depends on several geometrical features of the system: the diameter of the sheave 615, the diameter of the drum 625 of the line holding system 620, the distance L between these two and the ratio of the line diameter to the root diameter (D:d ratio) of the sheave 615 and the drum 625. (If the line handling device did not have a drum, the geometry would involve the shape of some other departure surface for the line 640.) In general terms, the curve profile of the compensation path will be arc-like with inflections resulting from wrapping and unwrapping of the line 640 on the sheave 615 and on the drum 625 of the line handling system as the sheave 615 travels in either direction around a central position on the compensation path. For example, when sheave 615 travels from the lower extreme position A to an upper position B as shown in FIG. 6. With a significant distance between the sheave 115 and the line's departure surface at the line handling system the arc of wrapping stated in terms of degrees will be relatively small, in many situations about 0.5 to 5 degrees. FIG. 6 shows in somewhat exaggerated terms the effects of wrapping when line 640 moves through angle Φ (again, the angle is shown exaggerated relative to a typical installation).

As can be seen, when sheave is 615 in position A, line 640 has a tangent point 660 on sheave 615 and a tangent point 650 on drum 625. When sheave 615 moves to position B, the tangent points migrate as wrapping occurs. Sheave 615 has a new tangent point 662 that arises when a segment S1 of line 640 is wrapped onto sheave 615. Similarly, drum 625 has a new tangent point 652 that arises when a segment S2 of line 640 is wrapped onto drum 625. The effect of this wrapping is to shorten the segment of line that extends between the two tangent points defined at sheave 615 and drum 625, because these are now closer together. Where sheave 615 and drum 625 have the same diameter, the amount of wrapping will be the same on each and the amount of shortening of the segment of line that extends between the two tangent points is essentially two times the amount of wrapping that occurs in the arc formed by migration of the respective tangent points defined at sheave 615 and drum 625. Thus, the curve profile 606 of the compensation path deviates from an arc-like ideal of a radius around a fixed point at drum 625, to allow for shortening of the line segment that extends between the two tangent points. The inflection of the curve profile is generally indicated by dotted line 607 at the upper portion of curve profile 606.

Figure 5:
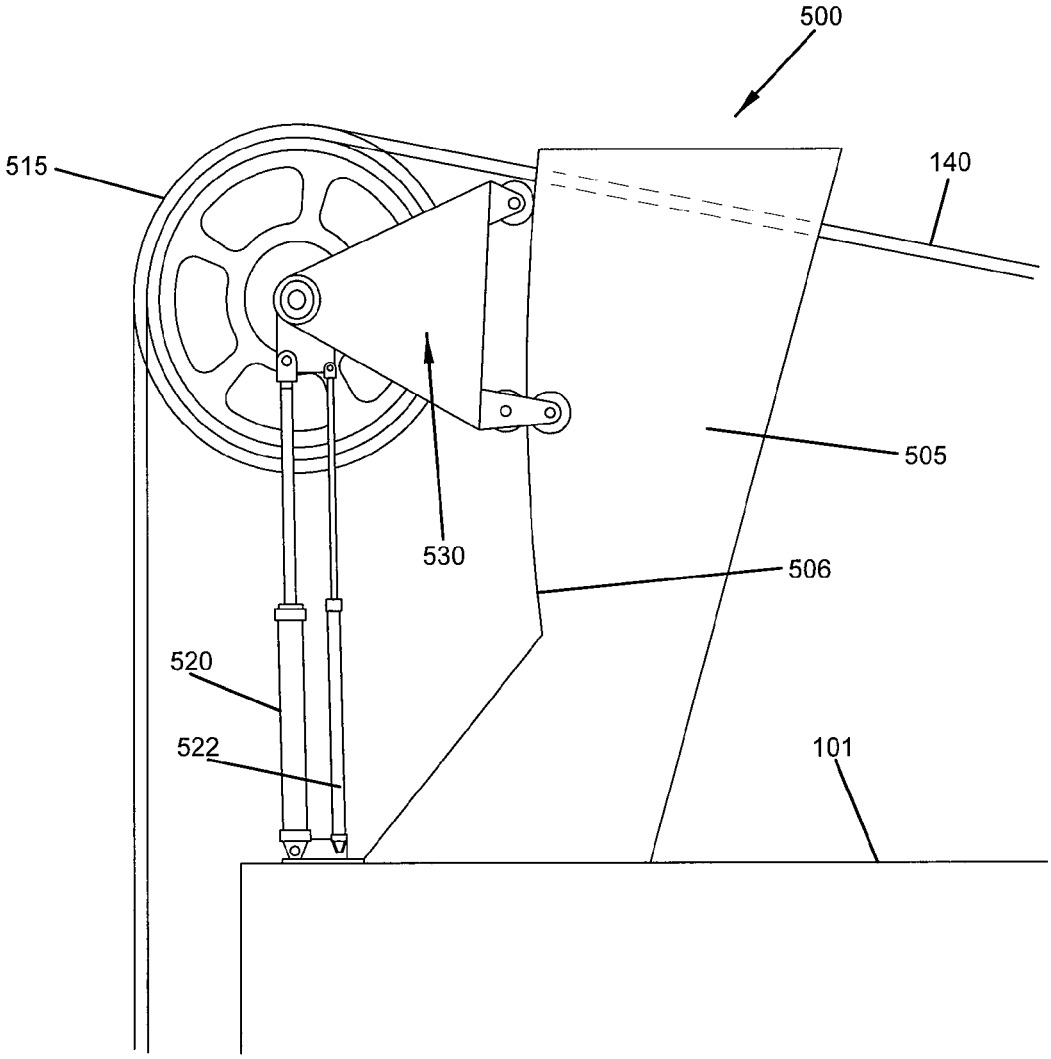
FIG. 5 depicts another heave compensation system.

In further embodiments, compensator control structures such as cylinders may additionally or alternatively be mounted on or in other areas of the base 105 or vessel 101. For example, compensator control structures may be mounted below a sheave mounting frame so that the compensators operate by pushing upward against the sheave mounting frame in order to move it in the upward direction along the compensation path. FIG. 5 depicts such an alternative embodiment. According to FIG. 5, cylinders 520, 522 of heave compensation apparatus 500 are mounted directly to vessel 101. This enables cylinders 520, 522 to support sheave mounting frame 530 from a position below the frame 530. In this embodiment, line 140 would pass above cylinders 520, 522 as it is carried by sheave 515 along curve profile 506 of base 505. Alternatively, the cylinders may be mounted on a surface of base 505 located below sheave mounting frame 530. It should be understood by those skilled in the art that cylinders 520, 522 or other extensible structures may be mounted on any surface that would enable the extensible structures to provide support and motion for the sheave mounting frame 530.

The embodiment described above in FIGS. 1-4 shows the support base 105 with the curve profile guide surfaces 106, 107 mounted on the deck of a vessel. In another embodiment, the support base 105 could be rigidly attached to the top of the A-frame 150, such that the compensation path is stably defined relative to the line from the line handling device 120 and the sheave 115 could be moved up and down within the A-frame, once it is positioned to place the load in the water. In such an embodiment, there would be no need to transfer the load from support of the load by the A-frame to support by a separate line on a heave compensation support base.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A device for providing heave compensation for a load suspended from one end of a line into a marine environment, with the other end of the line being handled by a line handling device located at a first location on a vessel, comprising:

a sheave support base located at a second location on the vessel displaced from the first location;

a sheave for receiving the line from the line handling device and directing the line to the load;

a sheave mounting frame with an axle for supporting the sheave for rotation, the sheave mounting frame being mounted on the sheave support base for reciprocating motion along a compensation path; and a compensator control operatively connected to the sheave mounting frame for causing the sheave mounting frame to controllably reciprocate along the compensation path in response to heaving motion of the vessel, the compensation path following a curve profile extending in the general direction of a heaving motion to be compensated, the curve profile being arc-like based on a center point defined by a tangent point of the line with the line handling device, the arc having at least one inflection to reduce line travel from effects of line wrapping at the sheave and line handling device during reciprocating motion.

2. The device of claim 1, wherein the compensation path is defined on the sheave support base.

3. The device of claim 1, wherein the length of the curve profile comprises an included angle of about +/−4 degrees or less.

4. The device of claim 1, wherein the curve profile is defined by at least one guide surface on the sheave support base, and the sheave mounting frame rides on the guide surface.

5. The device of claim 1, wherein the curve profile is defined by at least one guide surface on the sheave support base, and the sheave mounting frame has at least one roller that rolls on the guide surface.

6. The device of claim 1, wherein the curve profile is defined by a pair of parallel guide surfaces on the sheave support base and the sheave mounting frame has two rollers each rolling on one of the pair of parallel guide surfaces.

7. The device of claim 1, wherein the compensator control is an extensible structure operatively connected between the sheave mounting frame and sheave support base.

8. The device of claim 1, wherein the compensator control has passive cylinders that balance the load during heaving.

9. The device of claim 1, wherein the compensator control has active cylinders that control position of the load to a neutral position during heaving.

10. The device of claim 1, where the line handling device is a device for holding, paying out or in-hauling the line.

11. The device of claim 1, where the line handling device is a drum winch with a horizontal axis of rotation.

12. The device of claim 1 where the line handling device is a drum winch with a horizontal axis of rotation and part of a traction winch.

13. The device of claim 1 where the line handling device is a linear winch.

14. An apparatus for providing heave compensation for a load suspended from one end of a line into a marine environment, with the other end of the line being handled by a line handling device located at a first location on a vessel, comprising:

a sheave for receiving the line from the line handling device and directing it to the load, the sheave being mounted on an axle movably mounted in a sheave support located at a second location on the vessel displaced from the first location for reciprocating motion along a compensation path extending in the general direction of a heaving motion to be compensated, said compensation path being defined by a curve profile that keeps the axle of the sheave support at a substantially constant distance from a point at which the line intersects the line handling device, the curve profile being arc-like based on the intersection point, the arc having at least one inflection responsive to effects of line wrapping at the sheave and line handling device during reciprocating motion.

15. The apparatus of claim 14, wherein the line is a synthetic line and the length of the line segment extending from the line handling device to the sheave measured at the tangent point of the line segment to the sheave remains substantially constant.

16. The apparatus of claim 14, wherein the sheave support is operatively coupled to a motion reference unit, said motion reference unit sensing vessel motion and directing the sheave support to compensate for wave action so as to hold the load at a fixed position relative to a sea bed.

17. The apparatus of claim 16, wherein the sheave support comprises one or more extensible structures for moving the sheave along the compensation path in response to receiving data from the motion reference unit.

18. The apparatus of claim 17, wherein the one or more extensible structures exerts pressure on the sheave support equal to what is required to exert constant tension on the load.

19. The apparatus of claim 17, wherein the one or more extensible structures exerts pressure on the sheave support equal to what is required to maintain the load at a constant position.

20. The apparatus of claim 17, wherein the one or more extensible structures is at a neutral position when the one or more extensible structures are at a center of a movement stroke.

21. A method for providing heave compensation for a load suspended from one end of a line into a marine environment, with the other end of the line being handled by a line handling device located at a first location on a vessel, comprising:

securing a sheave support base at a second location on the vessel displaced from the first location;

providing a sheave for receiving the line from the line handling device and directing the line to the load;

mounting a sheave mounting frame on the sheave support base for reciprocating motion along a compensation path, said sheave mounting frame supporting said sheave via an axle; and operatively connecting a compensator control to the sheave mounting frame for causing the sheave mounting frame to controllably reciprocate, in response to heaving motion of the vessel, along a compensation path, the compensation path having a curve profile extending in the general direction of a heaving motion to be compensated, the curve profile being arc-like based on a center point defined by a tangent point of the line with the line handling device, the arc having at least one inflection to reduce line travel from effects of line wrapping at the sheave and line handling device during reciprocating motion.

22. The method of claim 21, further comprising defining the compensation path on the sheave support base.

23. The method of claim 21, further comprising defining the curve profile on at least one guide surface on the sheave support base, and guiding the sheave mounting frame on the guide surface.

24. The method of claim 21, wherein causing the sheave mounting frame to controllably reciprocate comprises providing load balancing during heaving.

25. The method of claim 21, wherein causing the sheave mounting frame to controllably reciprocate comprises providing neutral positioning of the load.

26. A method for providing heave compensation for a load suspended from one end of a line into a marine environment, with the other end of the line being handled by a line handling device located at a first location on a vessel, comprising:

receiving the line from the line handling device at a second location on the vessel displaced from the first location;

providing reciprocating motion for a line take-off point at the second location along a compensation path extending in the general direction of a heaving motion to be compensated, wherein the compensation path is defined by a curve profile that keeps a line segment defined by a length between a line take-off point at the first location and the line take-off point at a second location at a substantially constant length, the curve profile being arc-like based on the second location take-off point as arc center, the arc having at least one inflection responsive to effects of line wrapping at the respective take-off points during reciprocating motion.

27. The method of claim 26, wherein providing reciprocating motion along the compensation path comprises providing load balancing during heaving.

28. The method of claim 26, wherein providing reciprocating motion along the compensation path comprises providing neutral positioning of the load.

29. The method of claim 26, wherein the inflection adjusts for migration of the respective take-off points arising from wrapping the line on a surface at the first location and the second location.

* * * * *

UNITED STATES PATENT AND TRADEMARK OFFICE

CERTIFICATE OF CORRECTION

PATENT NO. : 7,798,471 B2
APPLICATION NO. : 11/838622
DATED : September 21, 2010
INVENTOR(S) : Terry Christopher It is certified that error appears in the above-identified patent and that said Letters Patent is hereby corrected as shown below:

| Column | Line | | Should Read |
|---|---|---|---|
| 4 | 15 | "stem" | -- stern -- |

Signed and Sealed this

Sixteenth Day of November, 2010

David J. Kappos

David J. Kappos
*Director of the United States Patent and Trademark Office*